US005339849A

United States Patent [19]

Stutz

[11] Patent Number: 5,339,849

[45] Date of Patent: Aug. 23, 1994

[54] DEVICE FOR REMOVEABLY JOINING TWO CRUTCHES

[76] Inventor: Joseph Stutz, Chatel-Dessous, Givrins, Switzerland, 1261

[21] Appl. No.: 163,706

[22] Filed: Dec. 9, 1993

Related U.S. Application Data

[60] Division of Ser. No. 904,901, Jun. 25, 1992, Pat. No. 5,295,499, which is a continuation of Ser. No. 731,877, Jul. 18, 1991, abandoned.

[30] Foreign Application Priority Data

Jul. 20, 1990 [CH] Switzerland ..... 02409/90
Feb. 1, 1991 [CH] Switzerland ..... 00324/91

[51] Int. Cl.[5] ..... A45B 3/00
[52] U.S. Cl. ..... 135/66; 135/68
[58] Field of Search ..... 135/66, 65, 68, 69; 248/96

[56] References Cited

U.S. PATENT DOCUMENTS 1,231,030 6/1917 Kelley ..... 248/96
1,870,924 8/1932 Platzer ..... 248/688
2,672,311 3/1954 Schiele ..... 248/96
3,606,898 9/1971 Harocopo ..... 135/68
4,506,854 3/1985 Kim ..... 248/96
4,834,235 5/1989 Solheim et al. ..... 248/96 X
4,921,192 5/1990 Jones ..... 248/96

FOREIGN PATENT DOCUMENTS 1090377 10/1960 Fed. Rep. of Germany ..... 135/68
3530387 2/1987 Fed. Rep. of Germany ..... 135/69
2589694 5/1987 France ..... 135/68
2193638 2/1988 United Kingdom ..... 135/69

*Primary Examiner*—Carl D. Friedman
*Assistant Examiner*—Lan C. Mai
*Attorney, Agent, or Firm*—Nixon & Vanderhye

[57] ABSTRACT

The handles of a pair of crutches have male and female coupling elements which enable them to be removably and totally fixed to one another. Crutches fixed in this manner can then be placed in a stable manner against any support at an elevation above their centre of gravity.

5 Claims, 2 Drawing Sheets

FIG.3
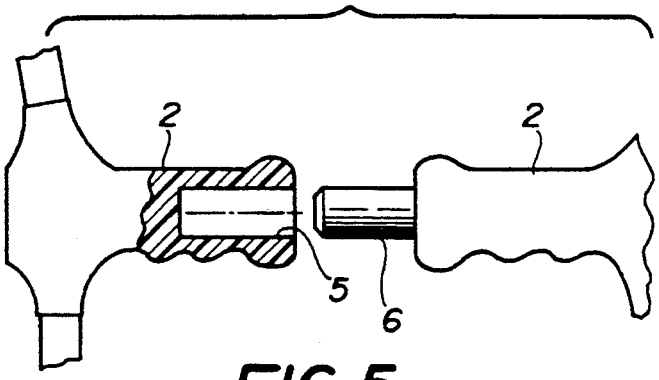
FIG.5
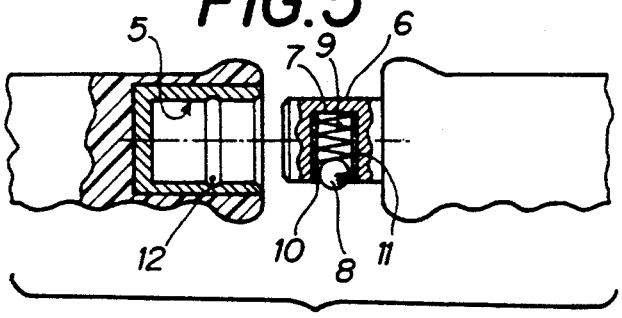
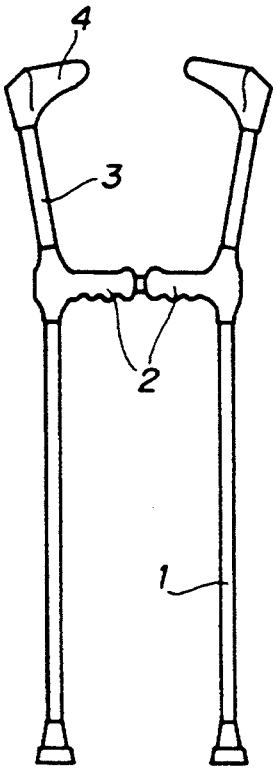
FIG.1
FIG.4
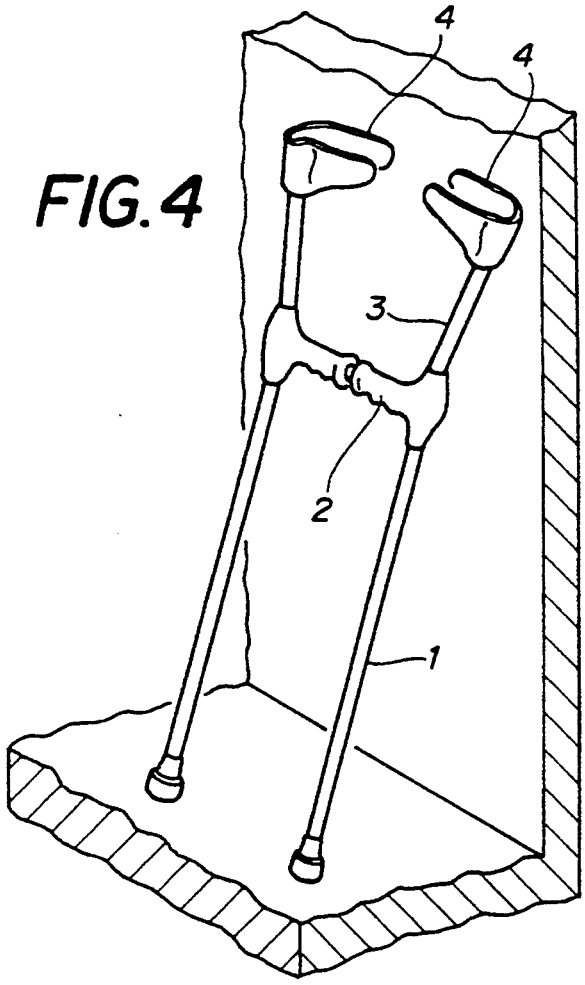
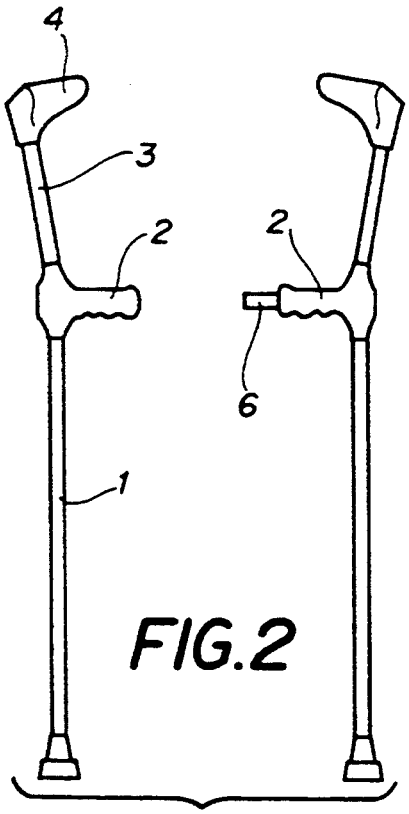
FIG.2

DEVICE FOR REMOVEABLY JOINING TWO CRUTCHES

This is a divisional of application Ser. No. 07/904,901, filed Jun. 25, 1992 now U.S. Pat. No. 5,295,499, which, in turn, is a file wrapper continuation of application Ser. No. 07/731,877, filed Jul. 18, 1991, now abandoned.

BACKGROUND OF THE INVENTION

The present invention relates to means for joining two crutches in a removable or separable manner, in particular in a symmetrical position. The invention is particularly but not solely concerned to ensure the stability of the joined crutches in the upright position when they are placed against a support situated above the level of their center of gravity.

DISCUSSION OF THE PRIOR ART

It is known to provide two complementary coupling elements, respectively on each of the two crutches of a pair, these elements having coupling axes which extend laterally with respect to the crutches and are situated at the same level on the two crutches.

German Patent Specification 35 30 387 describes means for removably joining two crutches in a symmetrical position comprising magnets or a Velcro (Registered Trade Mark) type material stuck on two symmetrical parts of the crutches to be joined. It has been found that these means of removably joining two crutches are not suitable for all the possible applications of joined crutches. In one such application the two crutches can be removably joined when one wishes to place the crutches against a support situated above the level of their center of gravity, in order to keep them upright; their being joined provides two support points on the ground. Magnets may possibly be suitable in such a case. However, joining the two crutches of a pair can have other, possibly more important, applications for the user. This is particularly the case when the user has to use a flight of stairs. it is obvious that joining of the two crutches is very advantageous, since it allows the user both to use one crutch and to have the other hand free to grip the handrail. However, in a situation of this type it is obvious that magnets or Velcro (Registered Trade Mark) are not suitable means for joining the two crutches. This is because when the two crutches are joined and only one of them is being used, the separable connection may need to be subjected to forces which may be great, in view of the lever arm which a crutch represents. The force thus exerted on the magnets has every chance of causing the connection to break and the crutch attached to that which the user is using to separate. If, in order to eliminate this risk, extremely powerful magnets, suitable for preventing accidental separation in situations of this type, are chosen, the user in that case will have to exert a correspondingly large force to separate the crutches in order to use the two crutches again. One must not neglect the fact that the elderly are among the most frequent users of crutches and the users are more often than not the infirm, who cannot be called upon to use great muscular effort to separate the crutches. Joining crutches with the aid of Velcro (Registered Trade Mark) material is even less good a solution, in particular when it comes to joining the two crutches for the purpose of descending or ascending a flight of stairs.

French Patent Specification 2 290 886 proposes to join two crutches in a separable manner using a coupling system of two tubular elements, the cross section of which is hexagonal in shape in order to prevent any rotary relative movement of the tubular elements and therefore of the crutches about the axis of coupling of these tubular elements.

It has been found that this solution has two disadvantages, one of which is that it is necessary to direct the two tubular coupling elements at a precise angle in order to make it possible to joing them, and the other of which is that the crutches cannot rotate about the coupling axis. By preventing such rotation, a rigid connection of the two crutches is formed which prevents them from adapting to the configurations either of the ground or of a support situated above their center of gravity, against which the assembled crutches are placed. Three support points are required to ensure the stability of the crutches. In joining them, the aim is to form two support points on the ground such that a third support point situated above the level of their center of gravity is sufficient to ensure the stability of the joined crutches in the upright position. By joining the crutches without allowing them to rotate about the axis of the coupling elements, this results in a unit which rests on the ground more often than not by only one of the two crutches, and is therefore unstable. Experience has shown that the assembled crutches are often placed against a support, situated above the level of their center of gravity, in such a manner than only one crutch rests on the ground, and because the rigidity of the assembly does not allow this fault to be corrected the two unstable crutches fall, which is precisely what the assembly aims to prevent.

Thus it will be seen that, although the idea of providing the two crutches of a pair with means for joining them in a separable manner is favorable, the means hitherto suggested are not suitable and they do not allow one to gain the maximum benefit which one might expect from the concept of crutches capable of being joined for the purpose of ensuring that they have a stable upright position when they are placed against a support situated above their center of gravity, which is no doubt the reason why it does not exist on the market.

The object of the present invention is to eliminate the above-mentioned disadvantages.

SUMMARY OF THE INVENTION

The present invention provides, in a device for removably joining two crutches in such a manner that the joined crutches are stable in an upright position when they are placed against a support situated above the level of their center of gravity, which device comprises two complementary coupling elements respectively provided on each of the said crutches and mutually interfittable along coupling axes extending laterally with respect to the crutches, said elements being situated at the same level on the two crutches, the improvement wherein the respective interfittable cross sections of the said elements are circular, such that when the said crutches are joined the said axes are collinear and the crutches are rotatable about the said axes.

Preferably, the interfittable elements are integrally formed on the crutches.

The device for removably joining two crutches according to the present invention is simple to manufacture and to handle. Its ability to maintain the assembled crutches in the position of use is independent of the force which joins them, so that it requires no effort to separate them; however, they are not capable of being separated accidentally in the position of use. Moreover, the flexibility of the assembly provided by the circular inter-fitting cross-sections, which at the same time constitute a genuine means of articulation of the assembled crutches, always enables the crutches to adopt a relative position in which they both rest on the ground, by rotating with respect to one another about their coupling axis of fitting.

BRIEF DESCRIPTION OF THE DRAWINGS

The attached drawings illustrate, diagrammatically and by way of example only, different embodiments of the present invention.

In the drawings:

FIG. 1 is an elevation of a pair of crutches joined together by coupling means in accordance with a first embodiment of the invention;

FIG. 2 is an elevation of the pair of crutches in FIG. 1, separated from one another;

FIG. 3 is a partial enlarged exploded view of the coupling means of FIGS. 1 and 2;

FIG. 4 is a perspective view of the pair of joined crutches placed on the ground and resting against a wall;

FIG. 5 is a view similar to FIG. 3 showing a second embodiment of the invention;

DESCRIPTION OF PREFERRED EMBODIMENTS

Figure 7:
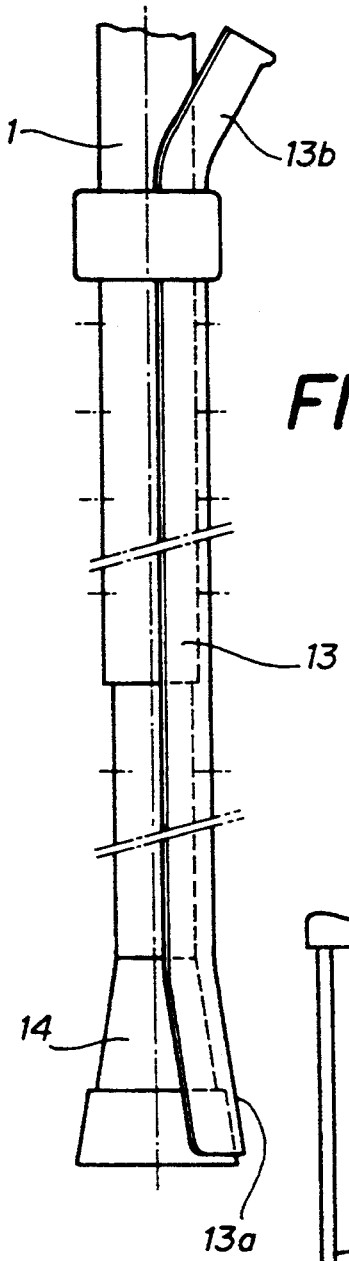
FIG. 7 is a side elevation of the lower portion of a crutch provided with the prop of FIG. 6, in a collapsed position.

The crutches illustrated in FIGS. 1 to 4 each have a supporting leg 1, and a hand-grip 2 which extends laterally from this leg 1. The leg is extended upwards by a slightly oblique part 3 which ends in a semi-circular supporting element 4 for the forearm.

As illustrated in FIG. 3, one hand-grip 2 has in its free end a female coupling element or socket 5 extending along the axis of the hand-grip, whilst the other hand-grip has a male coupling element (a pin or spigot) 6 which projects outwards from the free end of the hand-grip and coaxially with the hand-grip. The cross sections of these two coupling elements 5 and 6 are circular and of corresponding diameters, so that the male element or pin 6 can be inserted with a close fit in the socket 5 in order to join the two crutches together. Because the pin and socket are of circular cross section, the joined crutches can rotate about the common coupling axis of the inter-fitted pin and socket. These coupling elements are of a size such that, once they are fitted one into the other, they provide a means of adjustment without play, in order to achieve a mutual but removable joining of these crutches.

FIGS. 1 and 4 show the crutches removably joined to one another. Once the crutches have been joined, it is sufficient to find any support point situated above the level of their center of gravity, in order for these crutches to be stable on their two feet.

This removable joining of the crutches to one another serves mainly to provide a stable position when the crutches are placed against a support situated above the level of the center of gravity of the crutches. It can also be useful when the user wishes to free one hand for a moment, for example in order to grip a handrail.

FIG. 5 illustrates a second embodiment of the invention, in which the male element 6 has a housing 7, which opens laterally, in the fitting surface of this male element 6. This housing 7 contains a ball pressed outwards by a spring 9 and held in the housing by an annular edge 10 or a tube 11 inside the housing 7. The socket 5 has an annular internal circumferential detent groove 12 designed to receive the ball 8 when the male element 6 is fitted into the socket 5. This ball 8 has the purpose of preventing the coupling elements 5 and 6 from separating inadvertently and also enables the inter-fitted surfaces of the coupling elements 5, 6 to be adjusted more freely.

Figure 6:
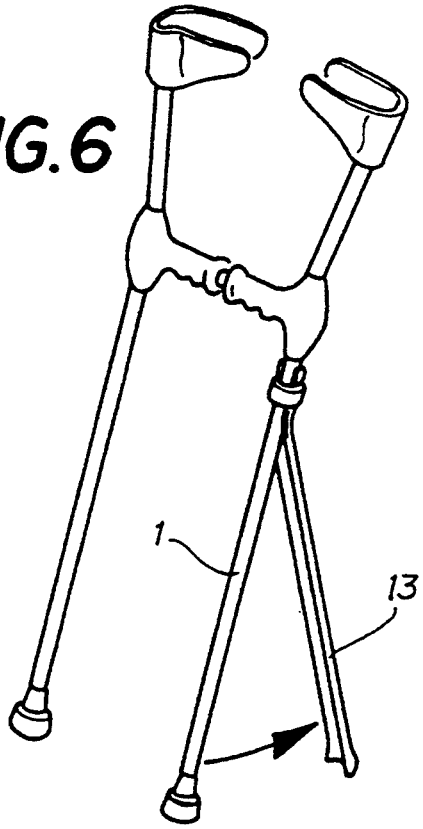
FIG. 6 is a perspective view similar to FIG. 4, showing a prop providing a third support point which can act as a substitute for an external support.
Figure 8:
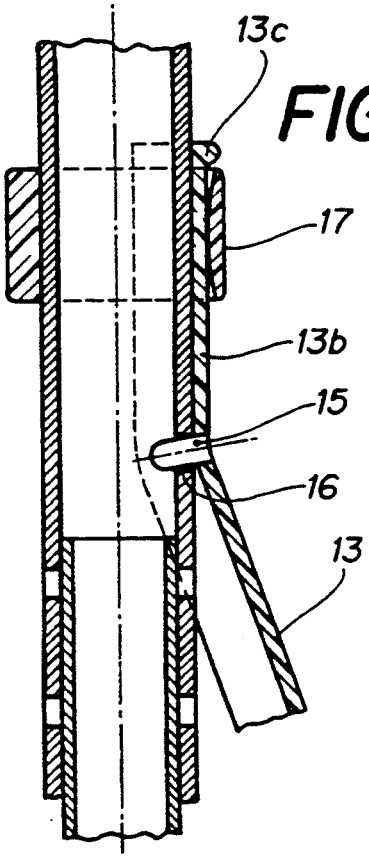
FIG. 8 is a sectional view of part of the crutch of FIG. 7, with the prop shown in the position of use.

FIGS. 6 to 8 show a collapsible support or prop 13 mounted on one of the crutches 1. This collapsible support 13, elongated in shape, has a semi-annular cross section for fitting against the tubular leg 1 of the crutch in the collapsed position (FIG. 7). The base 13*a* of the support 13 is flared in order to enable it to fit the end of the crutch, which in general is provided with an anti-slip attachment or ferrule 14. The major part of the length of the support 11 is rectilinear. A short distance below its upper extremity, the support includes an outward bend, above which is a short rectilinear portion 13*b* angled outwards relative to the main rectilinear lower portion of the support.

At the position of the bend in the support 11, a peg 15 provided on the support projects into the arcuate cross section of the support, and in use engages in an adjustment opening 16 provided in the leg of the crutch. It will be seen that when the upper portion 13*b* of the support rests against the crutch, the lower portion of the support is angled away from the leg of the crutch, and conversely, when the lower portion of the support rests against the crutch leg, the upper portion 13*b* is angled obliquely outwards and upwards from the crutch leg as seen in FIG. 7.

A ring 17 surrounds the support 13 and the crutch leg and is slidable up and down relative to the support and the crutch leg. This ring keeps the support assembled with the crutch leg. It serves also to set the relative positions of the support and crutch leg. When slid upwards over the support portion 13*b*, the ring 17 holds this upper support portion 13*b* against the tubular leg of the crutch, so that the lower main portion of the support is held angled away from the crutch leg as shown in FIGS. 6 and 8. The support can be moved to this angled position by the pressure exherted by the ring 17 as the latter is slid upwards along the leg, providing one handed adjustment of the support. Alternatively the support can be moved to its outwardly angled position by hand, the ring 17 being thereafter moved upwards along the support section 13*b*. If the ring is moved to a position below the pin 15, it holds the lower main portion of the support 13 tightly against the tubular portion of the crutch leg as shown in FIG. 7. Again, movement of the support from the position shown in FIGS. 6 and 8 to the collapsed position shown in FIG. 7 can be effected by movement of the ring 17 downwards along the leg and support, providing one handed adjustment of the support by means of the slidable ring 17.

The peg 15 serves to prevent the support 13 from moving along the leg 1 when the ring 17 is moved axially. A more sharply curved part or lip 13c provided at the top end of the support 13 (FIG. 8) prevents the ring 17 from moving beyond this end.

As illustrated by FIG. 6, when the two crutches are joined and the support 13 is moved away from the leg 1, it provides a third support point situated above the center of gravity of the crutches, thus keeping them upright without the presence of any external support. It is to be noted that the ability of the crutches to rotate about the axis of fitting of the coupling elements 5 and 6 is particularly significant in the case of this embodiment. Without this ability, it would be more or less impossible to ensure a stable position.

Figure 9:
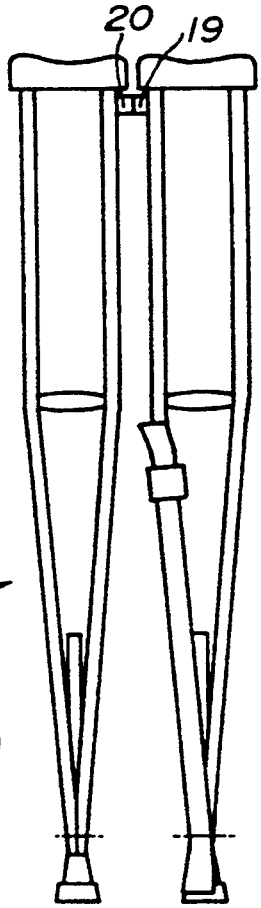
FIG. 9 is an elevation of a pair of crutches of another type, provided with means embodying the invention.

FIG. 9 illustrates an embodiment of the invention, which is suitable for another type of crutch. As in the construction illustrated by FIGS. 6 to 8, this pair of crutches 18 can be equipped with a support 13 which is identical to that illustrated by FIGS. 6 to 8. In this variation, the male and female fitting elements 19, 20 are preferably arranged at the top ends of the crutches.

The device which has been described is simple to manufacture as well as to use. Joining and separation the crutches requires a minimum of force. On the other hand, once the crutches are joined together, the user is able for example to ascend or descend a flight of stairs without risking seeing the crutches separate accidentally. In the embodiments of FIGS. 6–9, moving the support 13 away from the crutch and pushing it back are achieved simply by sliding the ring 17, an operation which can be carried out with one hand.

What is claimed is:

1. In a device for removably spacedly joining two crutches in symmetrical positions relative to one another with respect to a symmetrical plane and having a centre of gravity when joined, in such a manner that the joined crutches are stable in an upright position when they are placed against an upper point of support situated above the centre of gravity and have lower ends spaced from one another and engageable with a lower support to afford two lower spaced points of support, which device comprises two complementary male and female coupling elements respectively provided one on each of the said crutches and mutually interfittable along respective axes extending laterally with respect to the crutches, said elements being situated at a like elevation along the two crutches, the improvement wherein the said male and female elements have respective cylindrical interfittable surfaces and cross-sections circular about said respective axes, said crutches when joined with said male element received in said female element being rotatable relative to one another while guided about said axes such that said centre of gravity lies within lateral confines of the upper and lower points of support when projected onto a horizontal plane to afford stability to the crutches when joined to one another in the upright position, said axes being colinear and perpendicular to said symmetrical plane when the crutches are joined to one another.

2. The device according to claim 1 further including detent means provided on said coupling elements.

3. The device according to claim 1 wherein said elements have respective means with one another for preventing movement of said elements axially relative to one another, while simultaneously permitting said crutches to rotate about said axes, when said crutches are joined to one another.

4. The device according to claim 3 wherein said respective means includes a guide recessed within one of said elements and a projection on another of said elements engageable with said guide.

5. The device according to claim 3 wherein said respective means are releasable one from another to enable separation of said crutches one from the other.

* * * * *